United States Patent [19]

Evans

[11] 4,038,927

[45] Aug. 2, 1977

[54] POSITIONING MEANS

[75] Inventor: David Arthur Evans, Bristol, England

[73] Assignee: Strachan & Henshaw Limited, Bristol, England

[21] Appl. No.: 633,790

[22] Filed: Nov. 20, 1975

[30] Foreign Application Priority Data

Nov. 27, 1974 United Kingdom ..... 51491/74

[51] Int. Cl.[2] ..... B61J 3/12

[52] U.S. Cl. ..... 104/162; 104/176; 213/224

[58] Field of Search ..... 104/162, 176; 213/224; 105/462

[56] References Cited

U.S. PATENT DOCUMENTS

| | | | |
|---|---|---|---|
| 3,212,454 | 10/1965 | Ludwig | 213/224 |
| 3,695,185 | 10/1972 | Rose | 104/176 |

*Primary Examiner*—Albert J. Makay
*Assistant Examiner*—George F. Abraham

[57] ABSTRACT

A rail-car positioner comprises a carriage on a track running alongside and parallel to the train track and an elongate arm on the carriage is transversely displaceable to enter between a pair of coupled rail-cars of the train and connect the positioner drivingly to the train. The arm is extended substantially axially, from a retracted position on the carriage, in a preferably generally horizontal first direction to introduce an end of the arm between the pair of rail-cars, and said end is then engaged with the rail-cars' coupling by displacing it in a second direction transverse to the first direction.

13 Claims, 4 Drawing Figures

POSITIONING MEANS

BACKGROUND OF THE INVENTION

This invention relates to positioning means for rail vehicles, said means being of the kind in which a positioning carriage is movable along a path parallel to the rail track on which a train of rail vehicles runs, a positioner arm on the carriage being displaceable to and from a transversely projecting position in which it is located between a pair of vehicles of the train and connects the carriage thereto for moving the train to a required position along the track. Such means are employed, for example, in tippling installations for the discharge of bulk materials.

One known form of positioning means of this kind is described in UK Patent Specification No. 1,119,965 where a positioning carriage is provided with an arm that can be swung downwards from a retracted upright position to a horizontal extended position in which it is located adjacent the central coupling means between a pair of railroad cars. By having the driving connection from the positioning carriage disposed near the central vertical plane of the vehicles, the movement and control of heavy train loads is facilitated but there are disadvantages in this known arrangement, particularly as regards of controlling the movement of the arm as this is necessarily relatively massive.

In addition, there can sometimes be problems in providing access between vehicles for the movement of the arm to and from its operative position because in many designs of railroad car ancillary equipment and fittings overhang the ends of the vehicle.

SUMMARY OF THE INVENTION

The present invention provides positioning means of the kind described for a train of rail vehicles, and comprising an elongate positioner arm on the carriage, displacement and guide means on the carriage for displacing said arm in a first direction, substantially corresponding to the direction of axial extent of the arm, from a retracted position spaced from the train to an extended position in which the arm projects transversely of the carriage into the path of the train and an outer end of the arm is located between a pair of vehicles of the train, the arm being movable when in said extended position by said displacement and guide means to displace said end of the arm in a second direction in a vertical plane an transverse to said first direction, to connect it with at least one of said pair of vehicles for controlling the movement of the train by operation of the positioning carriage.

Thus, said axial movement of the arm may occur substantially horizontally and when in the extended position the projecting end of the arm can be arranged to move substantially vertically to engage coupling means between a pair of rail-cars of the train, said engagement being made from above or below the coupling means, whichever may be more convenient.

Preferably, said displacement and guide means comprise support means on which the arm is slidably mounted, said support means being located intermediate the length of the arm when the arm is in its retracted position. Said support means may comprise a plurality of supports at spaced positions longitudinally of the arm, the arm having a centre of gravity lying outside of the supports on which it bears in said transversely projecting extended position such that the weight of the arm urges said outer end in said second direction of displacement to make said connection with said at least one vehicle. Said supports are preferably also so arranged that the centre of gravity of the arm lies intermediate said supports when it is withdrawn to its retracted position.

Conveniently, there can be rotary drive means on the carriage, a mechanical linkage connecting said drive to the arm whereby rotation of said drive means produces said displacement of the arm in said first direction substantially corresponding to the direction of axial extent of the arm. Said trip means can, for example, comprise a fluid pressure actuator controlling a support for the arm, or a rotary cam and follower device providing such a support, the displacement of the support in each case resulting in said transverse displacement of the arm, whether by the support then being released from the arm or by it being brought to bear on the arm.

Because of the axial displacement of the arm, it is possible to provide guide means for the arm intermediate its length in a relatively simple manner. Such guide means may function as or be supplemented by bearing means through which at least a substantial part of the positioner traction effort is transmitted. In this way it is possible for the high loads from this source to be kept from the mechanism for displacement of the arm.

BRIEF DESCRIPTION OF THE DRAWINGS

The invention will be more particularly described by way of example with reference to the accompanying drawings, wherein.

DESCRIPTION OF PREFERRED EMBODIMENTS

Figure 1:
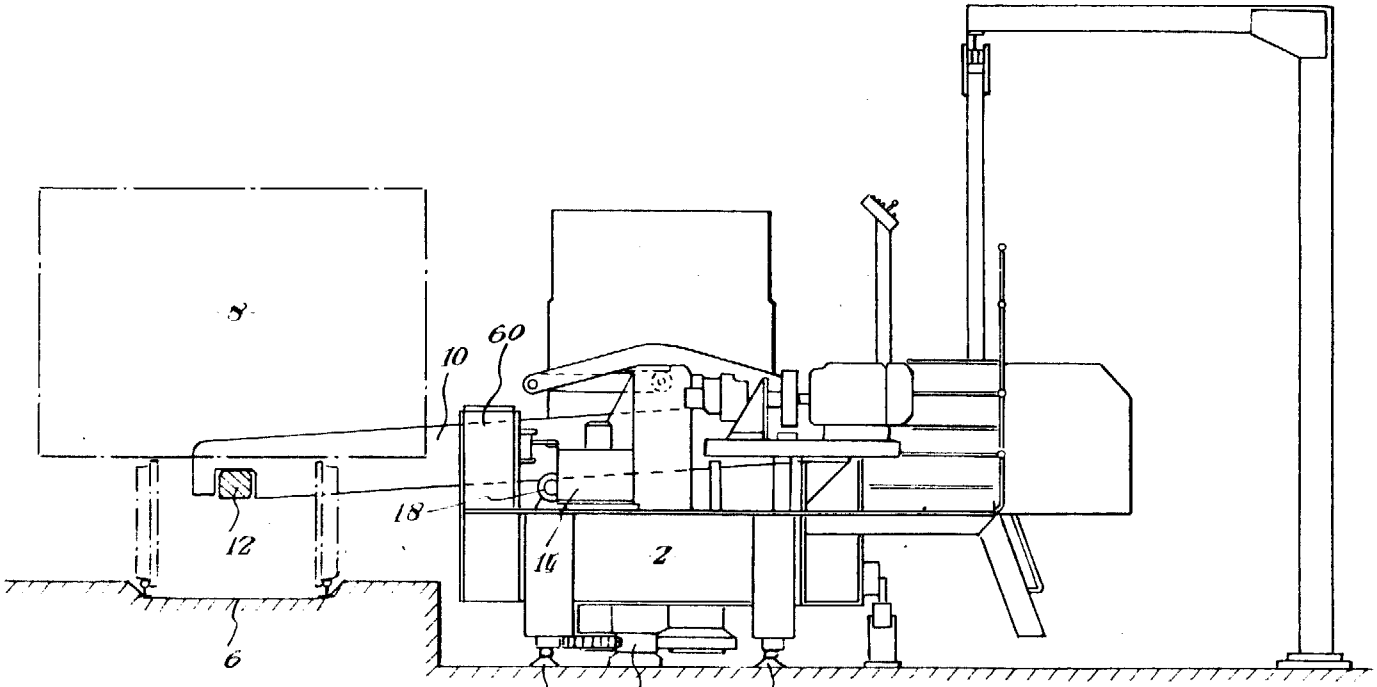
FIG. 1 is a diagrammatic end view of a train positioning installation incorporating positioning means according to the invention.
Figure 2:
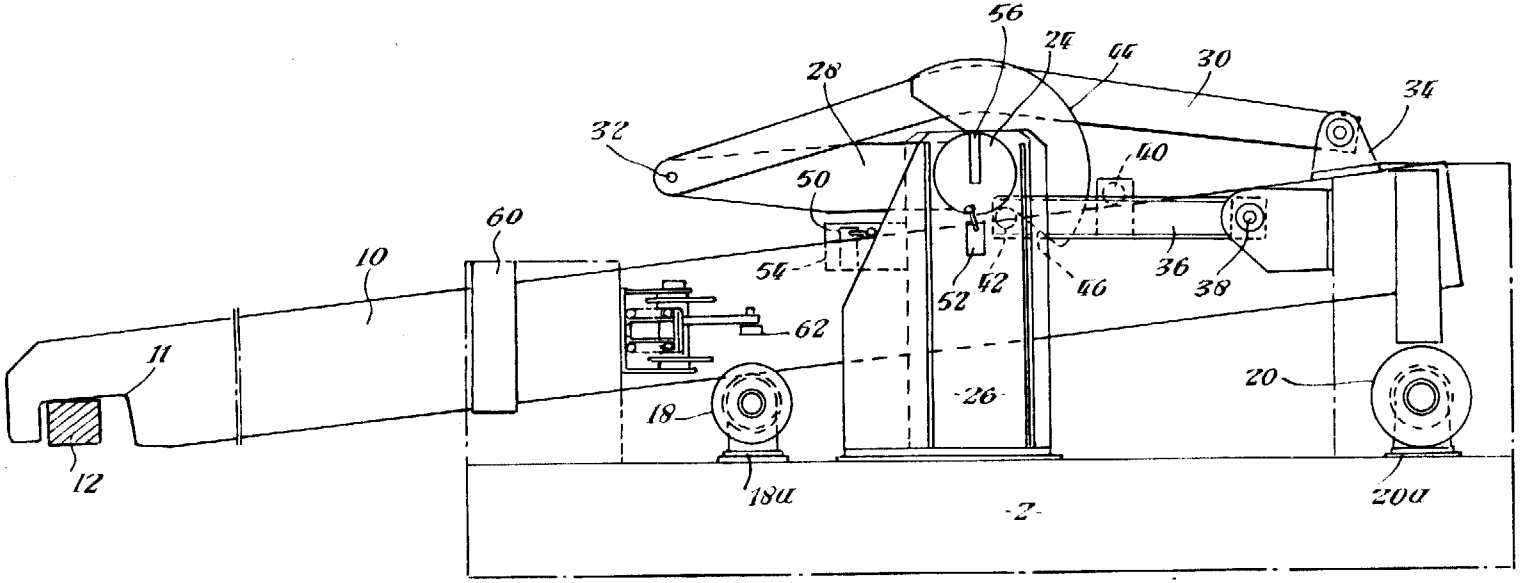
FIGS. 2 and 3 are an end view and a plan view respectively of the positioning means in the installation of FIG. 1.
Figure 3:
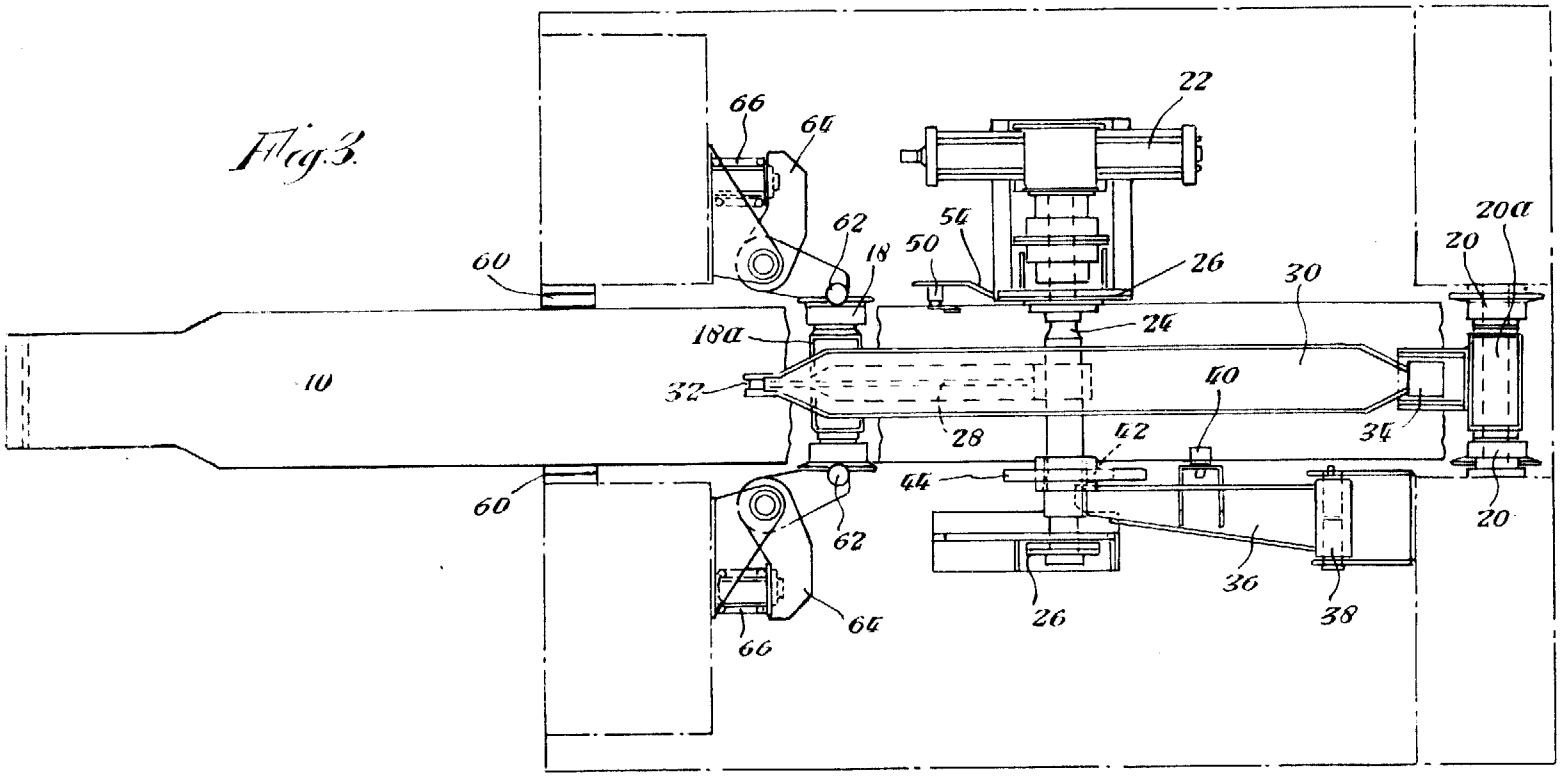

Referring to FIGS. 1 to 3 of the drawings, the positioner comprises a wheeled carriage 2 running on rails 4 parallel to a rail track 6 on which runs the train of wagons or railcars 8 to be moved by the positioner, e.g. for discharge of their contents in a railcar tippler. To couple the positioner to the train, an arm 10 on the carriage is displaceable in a plane transverse to the direction of the rail track, into engagement with the coupling between a pair of railcars, e.g. through a drawbar or shank 12 of the coupling which can be of conventional form. The manner of driving and control of the positioner carriage, using for example hydraulic motors 14 moving the positioner along a toothed rack 16, can be conventional, and will not be further described herein.

The positioner arm 10 is displaceable from the illustrated extended position, with the hooked outer end 11 (Fig. 2) engaging the coupling drawbar 12, to a retracted position in which it is laterally clear of the wagons or railcars 8. In that retracted position it rests horizontally upon laterally opposite pairs of rollers 18, 20 on respective mountings 18*a*, 20*a*, at opposite sides of the carriage 2. The arm is moved between its retracted and extended positions by a hydraulic actuator 22, a drive shaft 24 mounted on trunnions 26 being rotated by the actuator through 180°. This motion is translated into a substantially longitudinal movement of the arm 10 by a linkage comprising a crank 28 keyed to the shaft 24 and a link 30 that is pivoted at opposite ends to the outer end 32 of the crank and to a trunnion 34 at the inner end of the arm 10.

When retracted, the center of gravity of the arm lies between the roller pairs 18, 20 and as the arm is displaced outwards from the retracted position the center of gravity will move laterally to beyond the span of the roller pairs. During this displacement the arm is restrained from tipping anticlockwise, despite the movement of its centre of gravity outwardly of the roller pair 18, by an elongate control lever 36 pivoted to the positioner carriage at 38 and carrying a roller 40 that bears on the top edge of the arm.

A follower 42 on the end of the lever remote from the pivot 38 is engaged by a cam 44 fixed to the shaft which prevents the lever lifting so that the roller 40 thus holds the arm 10 positively in a horizontal position as the arm is slid outwards by the rotation of the shaft 24. Only at the extreme extended position of the arm does a fall 46 in the cam profile come into coincidence with the follower 42 on the end of the lever 36, so allowing the lever to rise, and the arm 10 is then able to pivot on the roller pair 18 by virtue of its own weight. The arm accordingly swings to the inclined position illustrated, the hooked end 11 of the arm dropping substantially vertically into engagement with the coupling drawbar 12.

In a similar manner, by rotation of the shaft in the opposite sense when the arm is in the illustrated position, the cam 44 will pivot the lever 36 downwards as the follower 42 moves to the increased radius portion of the cam when the rotation of the shaft 24 begins the lever 36 therefore acting through its roller 40 to raise the locked end 11 of the arm, and the arm is drawn back along the same horizontal path as that along which it was extended. It may be noted that because the raising and lowering of the hooked end 11 occurs when the drive crank is substantially horizontal, there is little or no axial motion of the arm at these stages and the movement of the hooked end will therefore be substantially vertical despite the fact that it is generated by the rotation of the drive shaft.

The rotation of the shaft 24 is terminated in each instance by respective limit switches 50, 52. The switch 50 is carried by a fixed bracket 54 and is operated by the arm as it tilts into engagement with the coupling 12, so operating an electrohydraulic servo, (not shown) which may itself be of conventional form, to stop the movement of the actuator as the coupling is engaged by the arm. Similarly, the switch 52 is operated by a radial striker 56 fixed to the shaft 24 to operate the actuator servo as the arm reaches its fully retracted position.

To avoid undue stresses on the linkage displacing the arm 10, fixed bearing abutments 60 are provided on the carriage to take the reaction forces that are applied to the arm when the positioner is moving the train with the arm engaging the coupling so avoiding high loadings on the displacement mechanism from these forces. During the displacement of the arm inwards and outwards, however, the arm is held clear of these abutments by side support rollers 62 mounted on levers 64 pivoted on the carriage, springs 66 urging the rollers into engagement with opposite sides of the arm to hold the arm centrally between the abutments 60.

Although the sliding extending movement takes place in a horizontal direction in the illustrated example it will be appreciated that it is possible to cause it to take an inclined direction, depending upon the relative positions of the roller pairs 18, 20 which determine the alignment of the arm axis. The final movement of the extended arm into and out of engagement with the coupling substantially in the vertical direction, as described, will normally be desirable, but it can also be in an inclined direction by suitable shaping of the fall in the cam profile and/ or modification of the drive linkage between the shaft 24 and the arm.

The vertical force with which the arm engages the coupling or drawbar is determined by the position of the roller pair 18 relative to the centre of gravity of the arm when the arm is extended. It can thus be kept relatively low to prevent damage by impact without requiring the use of massive counterweights or complex counterbalancing arrangements. The acceleration forces generated by the movement of the arm 10 can also be kept relatively low by virtue of the form of the mechanism between the arm and the shaft 24. Thus, in both end positions of the illustrated arrangement the crank 28 is substantially horizontal so that at these positions a given angular movement of the shaft causes only a minimal displacement of the trunnion 34 whereas in midstroke the same angular movement of the shaft gives a greater displacement as the crank is in or near its vertical position. When moving off from or approaching each end position, therefore, the arm 10 is given a gradual acceleration or retardation although the rate of displacement of the actuator will be similar throughout its stroke.

A further feature of the described construction is that, by virtue of the manner of movement of the positioner arm, which of necessity is a massive member weighing perhaps several tons, the risk of damage in the event of malfunction is relatively slight. This may be contrasted with known arrangements in which the arm is pivoted between vertical and horizontal positions: if malfunction allows the arm to drop when in an intermediate position it could acquire such momentum in falling as to cause considerable damage to anything it strikes.

The embodiment illustrated in FIGS. 1 to 3 can be modified in many ways within the scope of the invention. For example, different forms of drive can be employed to move the arm in and out, e.g. a hydraulic ram or a rack and pinion drive, and different means can be employed to give the transverse displacement to the extended arm.

Figure 4:
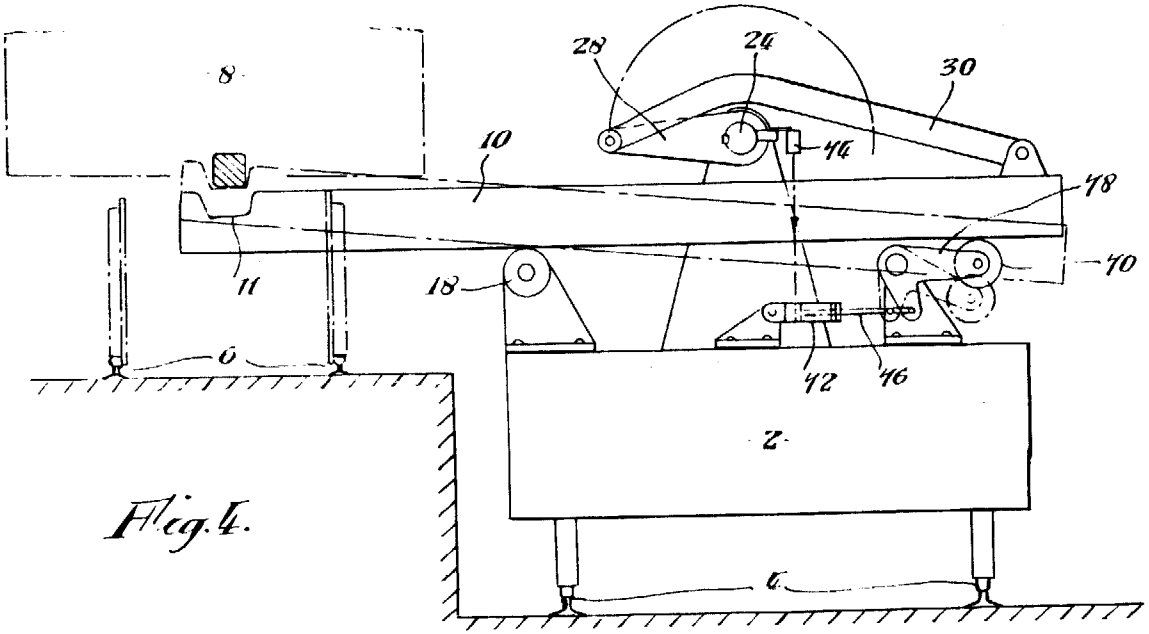
FIG. 4 is a schematic drawing illustrating some modifications of the positioning means in FIGS. 1 to 3.

FIG. 4 illustrates schematically, as an example, a modification in which a fluid pressure trip is provided for the transverse displacement of the arm. This figure, in which parts corresponding to those already described have been given the same reference numbers, also illustrates a modified movement pattern for the arm in which the train coupling is engaged from below. In the arrangement in FIG. 4, the arm 10 rests upon the fixed roller pair 18 and a displaceable roller pair 70 near its rear end. The rollers 70 remain in engagement with the arm even when it has moved to the illustrated extended position and the centre of gravity of the arm is always between the roller pairs 18, 70 both in its retracted and extended positions.

For tilting the arm to the coupling engaging position shown in broken lines a hydraulic actuator 72 is provided and is operated by a trip 74 from the shaft 24. Piston rod 76 of the actuator engages one arm of a bell crank lever 78 the other arm of which supports the roller pair 70 so that retraction of the piston rod lowers the roller pair 70 and allows the projecting end of the arm to rise. Conversely, the actuator is extended to disengage the arm from the coupling with the initiation of the return movement of the arm.

It is to be appreciated that the hydraulic actuator 72 can be employed in the embodiment of FIGS. 1 to 3 in direct substitution for the cam control shown there, and that it is also possible to employ a cam control similar to that described with reference to FIGS. 1 to 3 where the arm is arranged to rise into engagement with a coupling.

In each case, it is possible for the centre of gravity of the arm to stay within the span of the arm supports or for it to move, as the arm is extended, beyond said span to a position in which it tends to tilt the arm. There is some advantage to be obtained, however, if that mode of operation is chosen which brings the arm to the engaging position under its own weight as the arm is extended, as occurs in both the illustrated embodiments. This has the result that the arm will engage the coupling with a known force generated by its own weight, and this force remains the same even if the entrained railcar moves up and down as it travels along. By proportioning the moment arm about which the weight of the arm acts, the engagement force can be made small enough to avoid stressing the coupling unduly and yet large enough to prevent inadvertent disengagement.

What I claim and desire to secure by Letters Patent is:

1. Positioning means for a train of rail vehicles on a track comprising, in combination, a positioning carriage, a guide way for said carriage parallel to the track of the train, an elongate positioner arm on the carriage, displacement and guide means on the carriage for displacing said arm in a first direction, substantially corresponding to the direction of axial extent of the arm, from a retracted position spaced from the train to an extended position in which the arm projects transversely of the carriage into the path of the train and an outer end of the arm is located between a pair of vehicles of the train, the arm being movable when in said extended position by said displacement and guide means to displace said end of the arm in a second direction in a vertical plane and transverse to said first direction, to connect it with at least one of said pair of vehicles for controlling the movement of the train by operation of the positioning carriage, said displacement and guide means comprising rotary drive means on the carriage, a mechanical linkage connecting said drive to the arm whereby rotation of said drive means produces said displacement of the arm in said first direction substantially corresponding to the direction of axial extent of the arm.

2. Positioning means according to claim 1 wherein said displacement and guide means provide a substantially horizontal first direction of movement for the arm and further provide a substantially vertical second direction of movement for said outer end of the arm for engagement of said end with coupling means between the pair of vehicles when the arm is in said extended position.

3. Positioning means according to claim 1 wherein said displacement and guide means comprise support means on which the arm is slidably mounted, said support means being located intermediate the length of the arm when the arm is in its retracted position.

4. Positioning means according to claim 3 wherein said support means comprises a plurality of supports at spaced positions longitudinally of the arm, the arm having a center of gravity lying outside of the supports on which it bears in said transversely projecting extended position such that the weight of the arm urges said outer end in said second direction of displacement to make said connection with said at least one vehicle.

5. Positioning means according to claim 3 wherein said support means comprise a plurality of supports at spaced positions longitudinally of the arm, the arm having a center of gravity that in the retracted position of the arm is disposed intermediate the span of the supports on which it bears.

6. Positioning means according to claim 1 wherein said rotary drive mechanical linkage comprises a crank arm through which the rotary drive acts and that is directed substantially parallel to said first direction of displacement of the arm in the extended and/or retracted position of the arm.

7. Positioning means according to claim 1 further comprising trip means operated by said rotary drive means for producing said movement of the outer end of the arm in said second direction in predetermined sequence with said first direction displacement.

8. Positioning means according to claim 7 wherein said trip means comprises a fluid pressure actuator and means for operating said actuator in conjunction with the rotary drive means at a predetermined position, a support for the arm being displaced by said operation of the actuator when the arm is transversely extended and said displacement of said support by the actuator producing said movement of said end of the arm in the second direction.

9. Positioning means according to claim 7 wherein said trip means comprises a rotary cam that is displaced by the rotary drive means, and a device engaging said cam providing a support for the arm, said device being displaceable thereby in co-ordination with the movement of the rotary drive means by operation of the cam, the displacement of said device by the cam producing said movement of said end of the arm in the second direction.

10. Positioning means according to claim 1 further comprising resilient guide means mounted on the carriage for restraining movements of the arm longitudinally of the carriage in the direction of said guide way.

11. Positioning means according to claim 1 further comprising transverse bearing means mounted on the carriage and arranged for engagement with the arm to limit displacements thereof longitudinally of the carriage when the arm is the connecting position with said at least one vehicle.

12. Positioning means for a train of rail vehicles on a track comprising, in combination, a positioning carriage, a guide way for said carriage parallel to the track of the train, an elongate positioner arm on the carriage, displacement and guide means on the carriage for displacing said arm in a first direction, substantially corresponding to the direction of axial extent of the arm, from a retracted position spaced from the train to an extended position in which the arm projects transversely of the carriage into the path of the train and an outer end of the arm is located between a pair of vehicles of the train, the arm being movable when in said extended position by said displacement and guide means to displace said end of the arm in a second direction in a vertical plane and transverse to said first direction, to connect it with at least one of said pair of vehicles for controlling the movement of the train by operation of the positioning carriage, said displacement and guide means comprising a plurality of supports for the arm at spaced positions longitudinally of the arm, and the arm having a center of gravity that is disposed outside of the supports when in said extended position, such that the weight of the arm urges said outer end of the arm in said second direction of displacement to make said connection with said at least one vehicle.

13. Positioning means for a train of rail vehicles on a track comprising, in combination, a positioning carriage, a guide way for said carriage parallel to the track of the train, an elongate positioner arm on the carriage, displacement and guide means on the carriage for displacing said arm in a first direction, substantially corresponding to the direction of axial extent of the arm, from a retracted position spaced from the train to an extended position in which the arm projects transversely of the carriage into the path of the train and an outer end of the arm is located between a pair of vehicles of the train, the arm being movable when in said extended position by said displacement and guide means to displace said end of the arm in a second direction in a vertical plane and transverse to said first direction, to connect it with at least one of said pair of vehicles for controlling the movement of the train by operation of the positioning carriage, said displacement and guide means comprising a plurality of supports at spaced positions longitudinally of the arm, the arm having a center of gravity that in the retracted position of the arm is disposed intermediate the span of the supports on which it bears.

* * * * *